US009833670B2

(12) United States Patent
Fossum

(10) Patent No.: US 9,833,670 B2
(45) **Date of Patent: *Dec. 5, 2017**

(54) GOLF CLUB HEADS WITH FACE DEFLECTION JUNCTIONS AND RELATED METHODS

(71) Applicant: KARSTEN MANUFACTURING CORPORATION, Phoenix, AZ (US)

(72) Inventor: Brandon L. Fossum, Phoenix, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/287,185

(22) Filed: Oct. 6, 2016

(65) Prior Publication Data

US 2017/0021240 A1 Jan. 26, 2017

Related U.S. Application Data

(63) Continuation of application No. 14/454,177, filed on Aug. 7, 2014, now Pat. No. 9,474,945.

(60) Provisional application No. 61/863,840, filed on Aug. 8, 2013.

(51) Int. Cl.
*A63B 53/08* (2015.01)
*A63B 53/04* (2015.01)

(52) U.S. Cl.
CPC ..... *A63B 53/08* (2013.01); *A63B 53/04* (2013.01); *A63B 53/0466* (2013.01); *A63B 2053/042* (2013.01); *A63B 2053/045* (2013.01); *A63B 2053/0408* (2013.01); *A63B 2053/0416* (2013.01); *A63B 2053/0425* (2013.01); *A63B 2053/0429* (2013.01); *A63B 2053/0445* (2013.01); *A63B 2209/00* (2013.01); *Y10T 29/49* (2015.01)

(58) Field of Classification Search
CPC .... A63B 2053/0429; A63B 2053/0425; A63B 2053/042; A63B 2053/0416; A63B 53/08
USPC ..... 473/329, 342, 345, 347, 349, 350
See application file for complete search history.

(56) References Cited

U.S. PATENT DOCUMENTS

| | | | | |
|---|---|---|---|---|
| 1,705,997 | A | 3/1929 | Quynn | |
| 7,140,974 | B2 | 11/2006 | Chao et al. | |
| 7,316,622 | B1 | 1/2008 | Lucas | |
| 8,210,961 | B2 | 7/2012 | Finn et al. | |
| 8,911,301 | B1 | 12/2014 | Allen | |
| 2004/0033844 | A1 | 2/2004 | Chen | |
| 2004/0192463 | A1 | 9/2004 | Tsurumaki et al. | |
| 2007/0021234 | A1 | 1/2007 | Tsurumaki et al. | |
| 2011/0111885 | A1* | 5/2011 | Golden ..... | A63B 53/0466 473/342 |
| 2011/0256954 | A1 | 10/2011 | Soracco | |
| 2012/0088599 | A1 | 4/2012 | Narita | |
| 2013/0165252 | A1 | 6/2013 | Rice | |
| 2013/0324297 | A1 | 12/2013 | Larson | |
| 2013/0331201 | A1 | 12/2013 | Wahl | |
| 2015/0045139 | A1 | 2/2015 | Fossum | |
| 2015/0094163 | A1 | 4/2015 | Motokawa | |

* cited by examiner

*Primary Examiner* — Benjamin Layno

(57) ABSTRACT

Embodiments of golf club heads with deflection junctions are described herein. Other examples and related methods are also disclosed herein.

20 Claims, 7 Drawing Sheets

GOLF CLUB HEADS WITH FACE DEFLECTION JUNCTIONS AND RELATED METHODS

CROSS-REFERENCE TO RELATED APPLICATIONS

This is a continuation of U.S. Non-Provisional Patent Application No. 14/454,177, filed on Aug. 7, 2014, now U.S. Pat. No. 9,474,945 issued on Oct. 25, 2016, which claims priority to U.S. Provisional Patent Application No. 61/863,840, filed on Aug. 8, 2013.

The disclosure of the referenced application is incorporated herein by reference.

TECHNICAL FIELD

This disclosure relates generally to sports equipment, and relates more particularly to golf club heads and related methods.

BACKGROUND

Golf clubs and specifically golf club heads of various designs have typically been developed to improve a person's golf swing and resulting golf shot. In particular, many people are unable to hit or lack consistency when hitting "down" on a ball, that is, to regularly hit the ball squarely. Golf club designs and, particularly, golf club head designs may optimize a golf club head's impact on the golf ball, such that the golf club head can impart better flight characteristics to the golf ball, such as increased launch angle, increased speed, and/or decreased ball spin. Such designs may mitigate a person's inconsistency problems.

Figure 1:
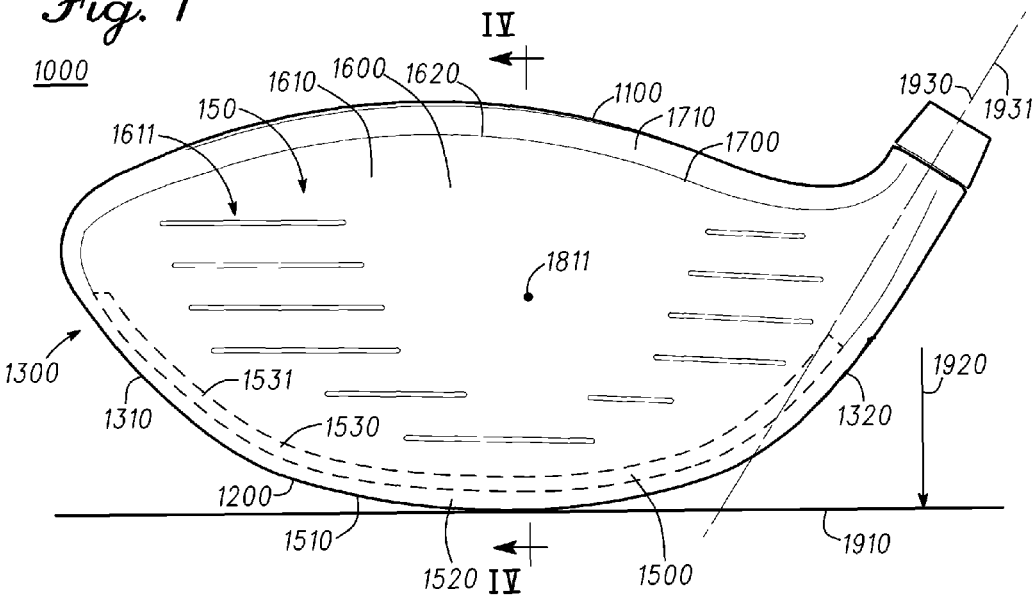
FIG. 1 illustrates a front view of a golf club head at address according to an embodiment.

For simplicity and clarity of illustration, the drawing figures illustrate the general manner of construction, and descriptions and details of well-known features and techniques may be omitted to avoid unnecessarily obscuring the disclosure. Additionally, elements in the drawing figures are not necessarily drawn to scale. For example, the dimensions of some of the elements in the figures may be exaggerated relative to other elements to help improve understanding of embodiments of the present disclosure. The same reference numerals in different figures denote the same elements.

The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments described herein are, for example, capable of operation in sequences other than those illustrated or otherwise described herein. Furthermore, the terms "include," and "have," and any variations thereof, are intended to cover a non-exclusive inclusion, such that a process, method, system, article, device, or apparatus that comprises a list of elements is not necessarily limited to those elements, but may include other elements not expressly listed or inherent to such process, method, system, article, device, or apparatus.

The terms "left," "right," "front," "back," "top," "bottom," "over," "under," and the like in the description and in the claims, if any, are used for descriptive purposes and not necessarily for describing permanent relative positions. It is to be understood that the terms so used are interchangeable under appropriate circumstances such that the embodiments of the disclosure described herein are, for example, capable of operation in other orientations than those illustrated or otherwise described herein.

The terms "couple," "coupled," "couples," "coupling," and the like should be broadly understood and refer to connecting two or more elements mechanically and/or otherwise. Two or more mechanical elements may be mechanically coupled together, but not be electrically or otherwise coupled together. Coupling may be for any length of time, e.g., permanent or semi permanent or only for an instant.

"Electrical coupling" and the like should be broadly understood and include coupling involving any electrical signal, whether a power signal, a data signal, and/or other types or combinations of electrical signals. "Mechanical coupling" and the like should be broadly understood and include mechanical coupling of all types.

The absence of the word "removably," "removable," and the like near the word "coupled," and the like does not mean that the coupling, etc. in question is or is not removable.

DESCRIPTION

In one embodiment of the golf club heads and related methods described herein, a golf club head comprises a crown, a sole, a toe skirt, a heel skirt, and a front end. The front end further comprises a strikeplate, which comprises a strikeface, a backface, and a strikeplate perimeter, a fixed joint between the strikeplate and a joint segment comprising of a front of the crown, and a deflection junction configured to permit deflection between the strikeplate and a junction segment comprising of a front of the sole. The deflection junction further comprises a junction structure extending from the junction segment and a junction slot defined between the strikeplate perimeter and the junction structure. The strikeplate perimeter is disconnected from the junction of the segment and the strikeplate and the junction structure are non-welded to each other. Further, the deflection junction comprises a pivot bend between the junction segment and the junction structure and is configured to permit pivoting of the junction structure relative to the junction segment upon impact between the strikeface and a golf ball. In addition, the junction structure overlaps an overlap segment of the backface, proximate to the strikeplate perimeter, and along the deflection junction. The deflection junction also comprises a compressible material located at the junction slot. The compressible material extends from the junction structure to the strikeplate perimeter and from the junction structure to the backface of the strikeplate. The junction slot and the compressible material comprise a bend to continuously extend from the strikeplate perimeter to the backface of the strikeplate. Additionally, the junction slot is not exposed to an underside of the golf club head, and a forward end of the junction slot is visible from forward of the front end of the golf club head.

In another embodiment of golf club heads and related methods, the fixed joint between the strikeplate and the joint segment may comprise a front of the sole, and the deflection junction configured to permit deflection between the strikeplate and a junction segment may comprise a front of the crown. Further, in another embodiment of golf club heads and related methods, the fixed joint between the strikeplate and a joint segment may comprise a front of the toe skirt and the deflection junction configured to permit deflection between the strikeplate and a junction segment may comprise a front of the heel skirt. Similarly, in another embodiment of golf club heads and related methods, the fixed joint between the strikeplate and a joint segment may comprise a front of the heel skirt, and the deflection junction configured to permit deflection between the strikeplate and a junction segment may comprise a front of the toe skirt.

There can be examples in accordance with the present disclosure where the deflection junction configured to permit deflection between the strikeplate and the junction segment may comprise a front of the crown and either the front of the toe skirt or the front of the heel skirt. In another example, the deflection junction may comprise a front of the sole and either the front of the toe skirt or the front of the heel skirt. Further, in another example, the deflection junction may comprise the front of the toe skirt, the front of the sole, and the front of the heel skirt. And in another example, the deflection junction may comprise the front of the toe skirt, the front of the crown, and the front of the heel skirt.

In another embodiment of the golf club head and related methods, the golf club head described herein can comprise a loft plane and a backplane parallel to the loft plane. The strikeface comprises a strikepoint through which the loft plane extends and the backface comprises a backpoint located opposite the strikepoint and through which the backplane extends. In addition, the junction structure comprises a front wall portion, located between the loft plane and the backplane, and a rear wall portion, located rearwards of the backplane. The front wall portion of the junction structure is non-perpendicular to the loft plane, the rear wall portion overlaps the overlap segment of the backface, and the rear wall portion and the portion of the backface remain separated from each other throughout impact of the strikeface with a golf ball. Further, the rear wall portion of the junction structure is substantially parallel to at least one of the loft plane or the overlap segment of the backface. In addition, the compressible material comprises at least one of a polyurethane material, a rubber material or a Poisson ratio greater than approximately 0.4. In addition, the minimum thickness of the junction slot, from the backface to the junction structure, is at least approximately 0.5 mm (millimeter). Upon impact between the strikeface and a golf ball at approximately 50 miles per hour (mph) to approximately 150 mph the deflection junction permits the strikeplate perimeter to deflect, relative to the junction structure, between approximately 0.5 mm to approximately 1.5 mm.

In an embodiment of golf club heads and related methods, a method for providing a golf club head comprises providing a crown, a sole, a toe skirt, and a heel skirt, and providing a front end of the golf club head. Providing a front end of the golf club head comprises providing a strikeplate comprising a strikeface, a backface, and a strikeplate perimeter, providing a fixed joint between the strikeplate and a joint segment comprising a front of one of the crown, the sole, the toe skirt, or the heel skirt, and providing a deflection junction configured to permit deflection between the strikeplate and a junction segment comprising a front of a different one of the crown, the sole, the toe skirt, or the heel skirt. The deflection junction comprises a junction structure extending from the junction segment and a junction slot defined between the strikeplate perimeter and the junction structure. In addition, the strikeplate perimeter is disconnected from the junction segment.

There can be examples in accordance with the present disclosure where the method of providing a golf club head can further include a deflection junction comprising a compressible material located at the junction slot and extended from the junction structure to at least one of the strikeplate perimeter or the backface of the strikeplate. The compressible material comprises at least one of a polyurethane material, a rubber material, or a Poisson ratio greater than approximately 0.4.

Examples and embodiments are further disclosed herein. Such examples and embodiments may be found in the figures, in the claims, and/or in the present description.

Figure 2:
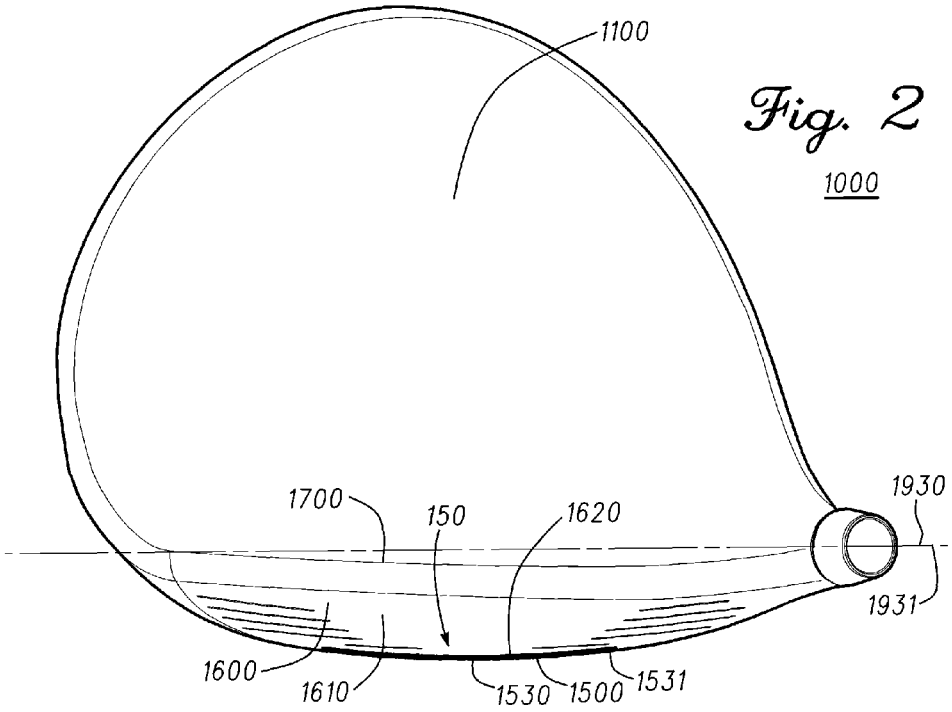
FIG. 2 illustrates a top view of the golf club head of FIG. 1 from an address point of view.
Figure 3:
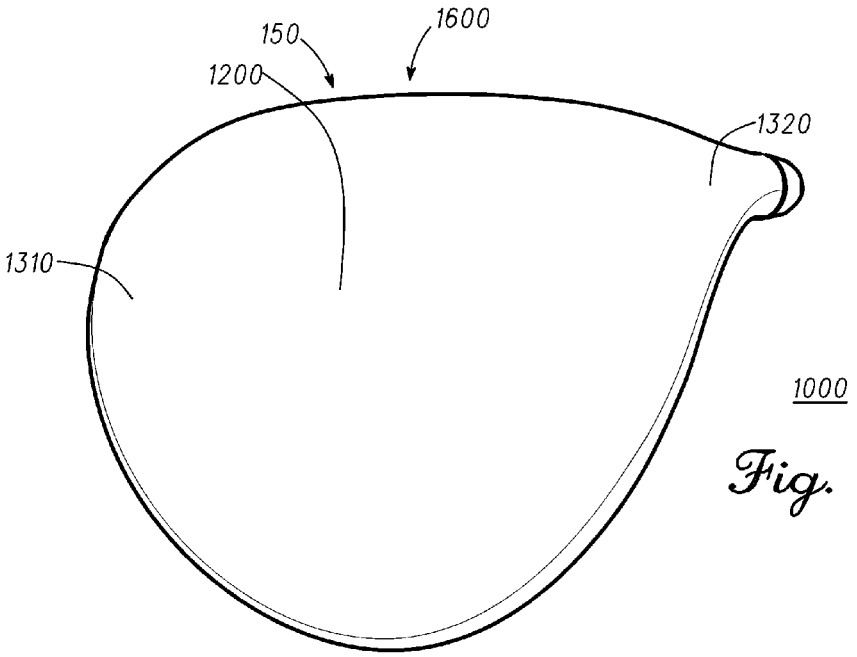
FIG. 3 illustrates an underside view of the golf club head.
Figure 4:
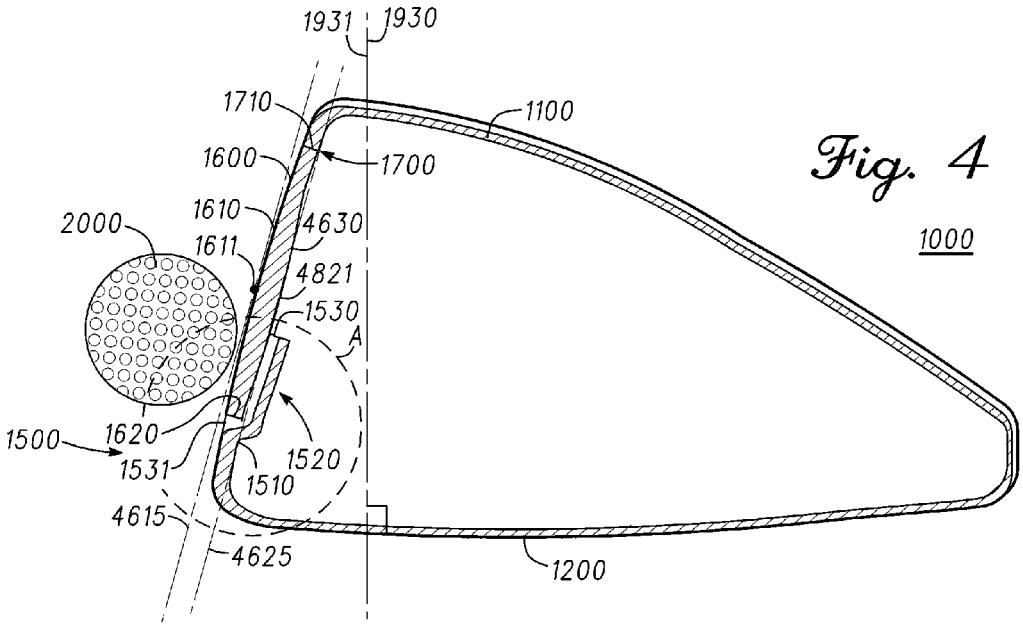
FIG. 4 illustrates a side address cross-sectional view of the golf club head with respect to line IV-IV of FIG. 1.

FIG. 1 illustrates a front address view of golf club head 1000. FIG. 2 illustrates a top view of golf club head 1000 from an address point of view. FIG. 3 illustrates an underside view of golf club head 1000. FIG. 4 illustrates a side address cross-sectional view of golf club head 1000 and with respect to line IV-IV of FIG. 1. Golf club head 1000 comprises crown 1100, sole 1200, skirt 1300 with toe skirt 1310 and heel skirt 1320, and front end 150 having strikeplate 1600 and deflection junction 1500. Strikeplate 1600 comprises strikeface 1610, and is coupled to golf club head 1000 at front end 150, where deflection junction 1500 is configured to permit or increase deflection of strikeplate 1600 upon ball impact with golf ball 2000 as shown in FIG. 4. In some embodiments, such deflection can influence ball launch characteristics of golf ball 2000 based on where the ball impact occurs at strikeface 1610.

As shown in FIGS. 1-2, golf club head 1000 is shown at address with respect to ground plane 1910, which is orthogonal to gravity vector 1920. Golf club head 1000 also comprises shaft axis 1930, which defines and extends along shaft axis plane 1931. As shown in FIG. 2, when golf club head 1000 is at address, shaft axis plant 1931 is orthogonal to ground plane 1910 (FIG. 1). In addition, as shown in FIG. 1, when golf club head 1000 is at address, grooves 1611 of strikeface 1610 can be parallel to ground plane 1910. As can be seen in FIG. 2, deflection junction 1500 is visible at front end 150 from an address point of view of golf club head 1000.

Strikeplate 1600 is coupled to front end 150 via fixed joint 1700 between strikeplate 1600 and joint segment 1710 of golf club head 1000. Fixed joint 1700 fixedly couples strikeplate 1600 to joint segment 1710, such that strikeface perimeter 1620 moves or remains in place in unison with joint segment 1710 upon ball impact with golf ball 2000. In some examples, fixed joint 1700 can comprise a weld joint, a brazed joint, and/or another fixed metallic joint between strikeface perimeter 1620 and joint segment 1710. Fixed joint 1700 can also comprise an integral joint, such as where strikeplate 1600 and joint segment 1710 are integral to each other or comprise a single piece of material.

Strikeplate 1600 is also coupled at front end 150 to deflection junction 1500, which is configured to permit deflection between strikeplate 1600 and junction segment 1510 such that strikeplate perimeter 1620 and junction segment 1510 can displace relative to each other and/or need not move in unison upon ball impact with golf ball 2000.

Deflection junction 1500 comprises junction structure 1520 extending from junction segment 1510, and junction slot 1530 defined between strikeplate perimeter 1620 and junction structure 1520, where junction slot 1530 comprises a gap that separates strikeplate perimeter 1620 from junction segment 1510, such that junction structure 1520 is disconnected from junction segment 1510. As seen in the present example, junction slot 1530 also separates strikeplate 1600 from junction structure 1520. Because of such separations, strikeplate 1600 can deflect upon impact with golf ball 2000 such that strikeplate perimeter 1620 can displace relative to junction segment 1510 and/or relative to junction structure 1520.

In some examples, joint segment 1710 of fixed joint 1700 can comprise a front segment of one of crown 1100, sole 1200, toe skirt 1310, and/or heel skirt 1320, while junction segment 1510 can comprise a front segment of a different one of crown 1100, sole 1200, toe skirt 1310, and/or heel skirt 1320. Accordingly, at least one of crown 1100, sole 1200, toe skirt 1310, or heel skirt 1320 won't be comprised by joint segment 1710, but will be comprised by deflection junction 1500 instead.

For instance, in the present example of FIG. 1, joint segment 1710 comprises front segments of crown 1100, toe skirt 1310, and heel skirt 1320, but does not extend to sole 1200 such as not to hinder deflection of strikeplate perimeter 1620 with respect to junction segment 1510. Correspondingly, junction segment 1510 comprises front segments of sole 1200, toe skirt 1310, and heel skirt 1320, but does not extend to crown 1100.

Figure 5:
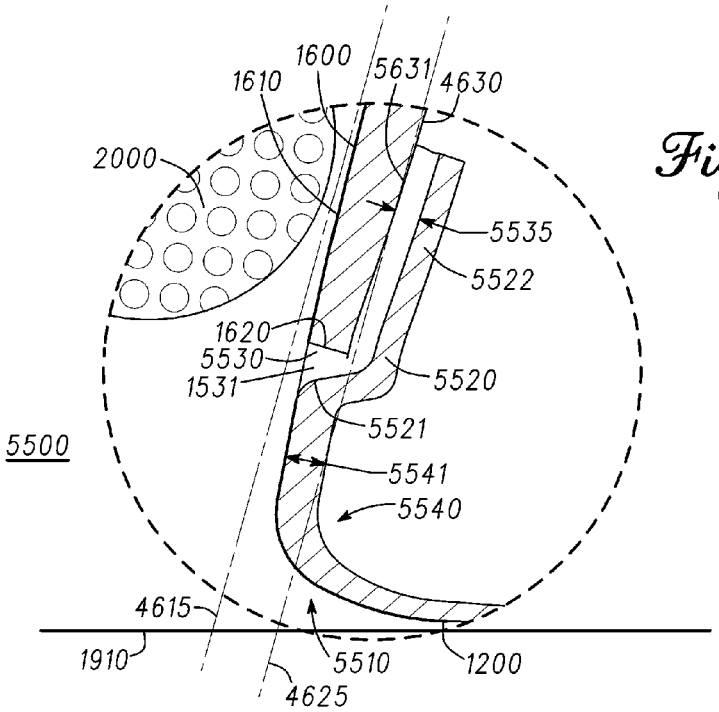
FIG. 5 illustrates a zoomed-in view of a deflection junction, which can represent to the deflection junction of any of the golf club heads described herein.

FIG. 5 comprises a zoomed-in view of strikeplate 1600 and deflection junction 5500, which can be similar to deflection junction 1500 (FIG. 1). For instance, circled section "A" in FIG. 4 can relate to the view of FIG. 5 such that junction segment 1510 (FIG. 4) can correspond to junction segment 5510 (FIG. 5), junction structure 1520 (FIG. 4) can correspond to junction structure 5520 (FIG. 5), and junction slot 1530 (FIG. 4) can correspond to junction slot 5530 (FIG. 5).

Figure 6:
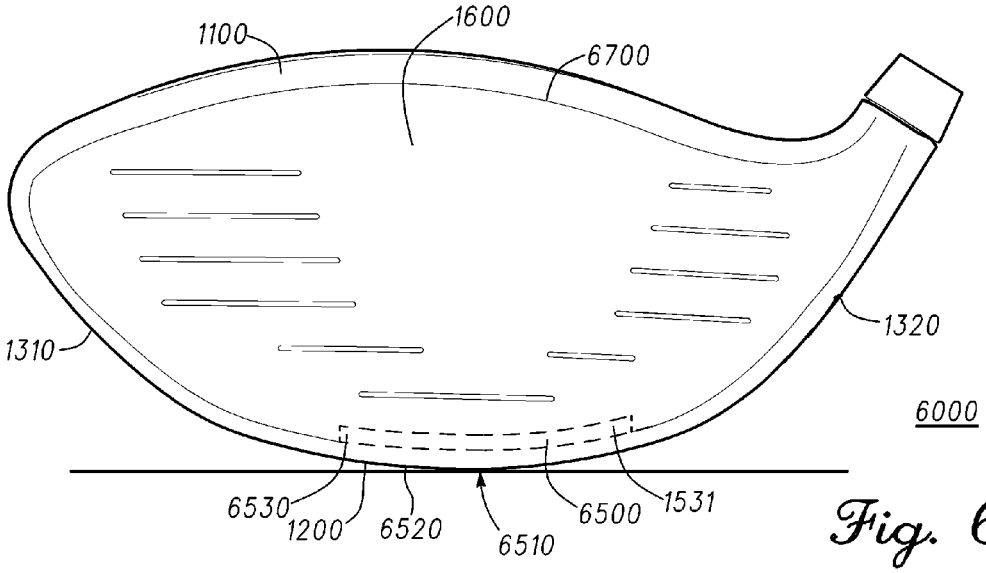
FIG. 6 illustrates a front view of another golf club head at address according to another embodiment.

Although FIG. 1 illustrates deflection structure 1500 located along front segments of sole 1200, toe skirt 1310, and heel skirt 1320, other embodiments can comprise similar deflection structure(s) located elsewhere. As an example, FIG. 6 illustrates a front view of golf club head 6000 comprising deflection junction 6500 located along a front segment of sole 1200, without extending to front segments of heel skirt 1320 or toe skirt 1310. In such an example, FIG. 5 can correspond to a cross-sectional view of golf club head 6000 through deflection junction 6500, where deflection junction 5500 (FIG. 5) corresponds to deflection junction 6500 (FIG. 6), where junction slot 5530 (FIG. 5) corresponds to junction slot 6530 (FIG. 6), where junction segment 5510 (FIG. 5) corresponds to junction segment 6510 (FIG. 6), and/or where junction structure 5520 (FIG. 5) corresponds to junction structure 6520 of deflection junction 6500 (FIG. 6).

Figure 7:
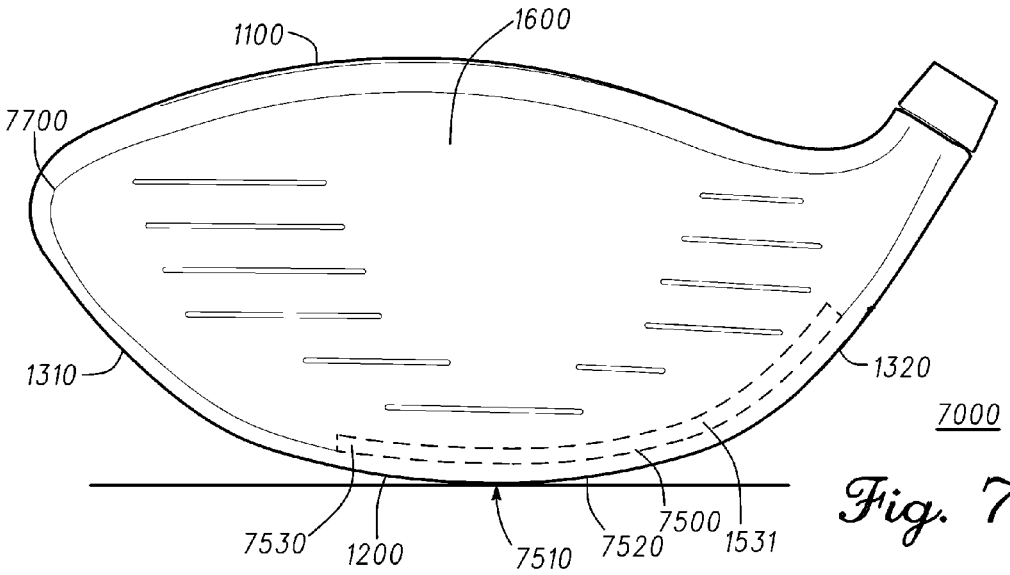
FIG. 7 illustrates a front view of another golf club head at address according to another embodiment.

FIG. 7 illustrates another example, presenting a front view of golf club head 7000 comprising deflection junction 7500 located along front segments of sole 1200 and heel skirt 1320, without extending to a front segment of toe skirt 1310. In such an example, FIG. 5 can correspond to a cross-sectional view of golf club head 7000 through deflection junction 7500, where deflection junction 5500 (FIG. 5) corresponds to deflection junction 7500 (FIG. 7), where junction slot 5530 (FIG. 5) corresponds to junction slot 7530 (FIG. 7), where junction segment 5510 (FIG. 5) corresponds to junction segment 7510 (FIG. 7), and/or where junction structure 5520 (FIG. 5) corresponds to junction structure 7520 of deflection junction 7500 (FIG. 7).

Figure 8:
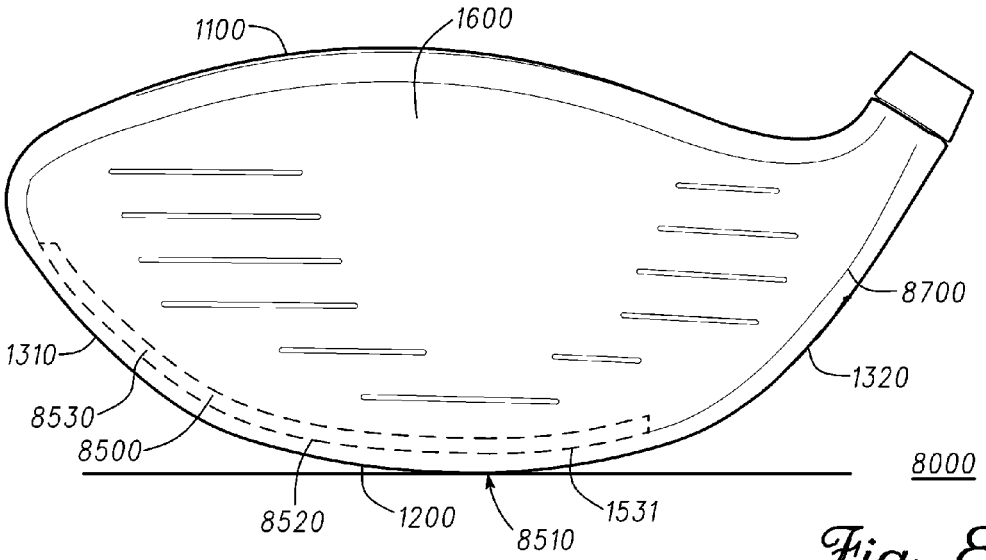
FIG. 8 illustrates a front view of another golf club head at address according to another embodiment.

FIG. 8 illustrates another example, presenting a front view of golf club head 8000 comprising deflection junction 8500 located along front segments of sole 1200 and toe skirt 1310, without extending to a front segment of heel skirt 1320. In such an example, FIG. 5 can correspond to a cross-sectional view of golf club head 8000 through deflection junction 8500, where deflection junction 5500 (FIG. 5) corresponds to deflection junction 8500 (FIG. 8), where junction slot 5530 (FIG. 5) corresponds to junction slot 8530 (FIG. 8), where junction segment 5510 (FIG. 5) corresponds to junction segment 8510 (FIG. 8), and/or where junction structure 5520 (FIG. 5) corresponds to junction structure 8820 of deflection junction 8500 (FIG. 8).

Figure 9:
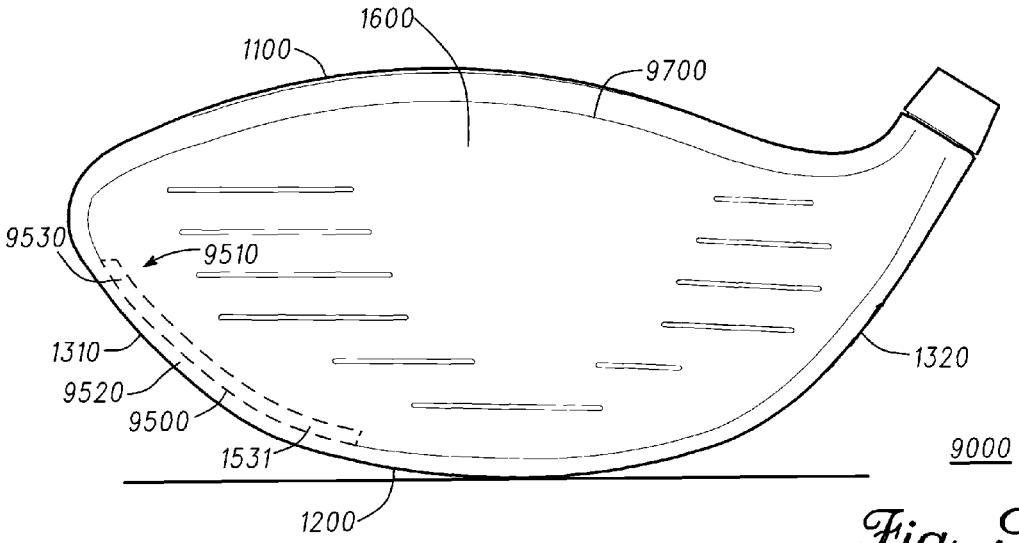
FIG. 9 illustrates a front view of another golf club head at address according to another embodiment.

FIG. 9 illustrates another example, presenting a front view of golf club head 9000 comprising deflection junction 9500 located along a front segment of toe skirt 1310, without extending to a front segment of heel skirt 1320 or of sole 1200. In such an example, FIG. 5 can correspond to a cross-sectional view of golf club head 9000 through deflection junction 9500, where deflection junction 5500 (FIG. 5) corresponds to deflection junction 9500 (FIG. 9), where junction slot 5530 (FIG. 5) corresponds to junction slot 9530 (FIG. 9), where junction segment 5510 (FIG. 5) corresponds to junction segment 9510 (FIG. 9), and/or where junction structure 5520 (FIG. 5) corresponds to junction structure 9520 of deflection junction 9500 (FIG. 9).

Figure 10:
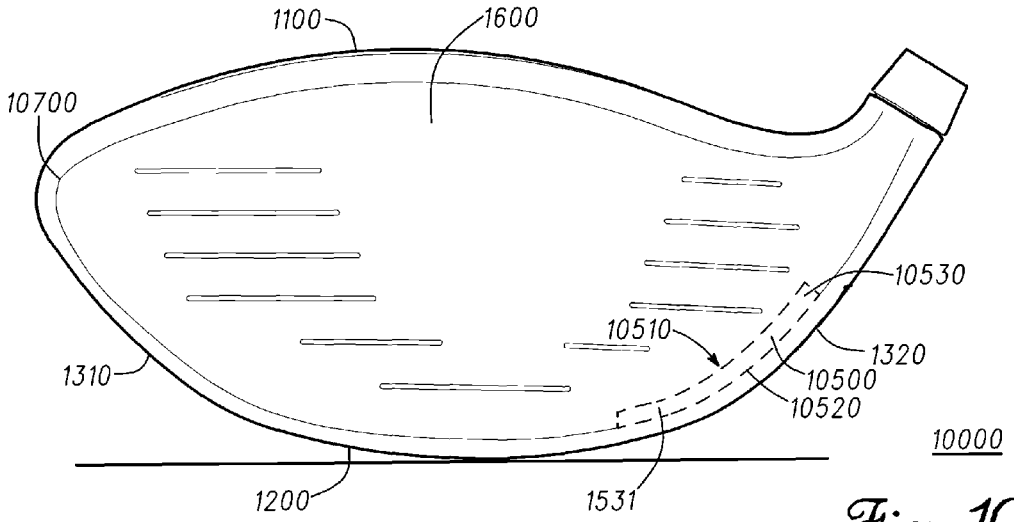
FIG. 10 illustrates a front view of another golf club head at address according to another embodiment.

FIG. 10 illustrates another example, presenting a front view of golf club head 10000 comprising deflection junction 10500 located along a front segment of heel skirt 1320, without extending to a front segment of toe skirt 1310 or of sole 1200. In such an example, FIG. 5 can correspond to a cross-sectional view of golf club head 10000 through deflection junction 10500, where deflection junction 5500 (FIG. 5) corresponds to deflection junction 10500 (FIG. 10), where junction slot 5530 (FIG. 5) corresponds to junction slot 10530 (FIG. 10), where junction segment 5510 (FIG. 5) corresponds to junction segment 10510 (FIG. 10), and/or where junction structure 5520 (FIG. 5) corresponds to junction structure 10520 of deflection junction 10500 (FIG. 10).

Figure 11:
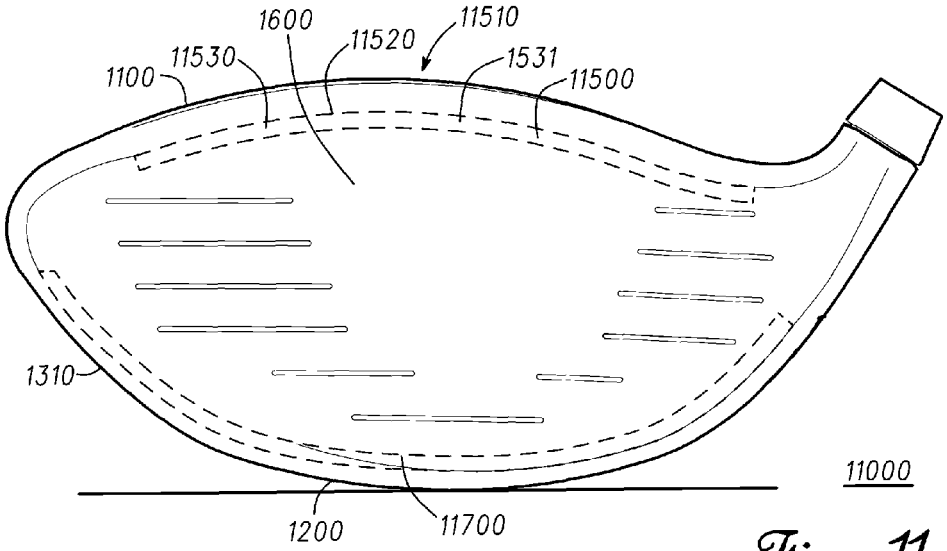
FIG. 11 illustrates a front view of another golf club head at address according to another embodiment.

FIG. 11 illustrates another example, presenting a front view of golf club head 11000 comprising deflection junction 11500 located along a front segment of crown 1100. In such an example, FIG. 5 can correspond to a cross-sectional view of golf club head 11000 through deflection junction 11500, where deflection junction 5500 (FIG. 5) corresponds to deflection junction 11500 (FIG. 11), where junction slot 5530 (FIG. 5) corresponds to junction slot 11530 (FIG. 11), where junction segment 5510 (FIG. 5) corresponds to junction segment 11510 (FIG. 11), and/or where junction structure 5520 (FIG. 5) corresponds to junction structure 11520 of deflection junction 11500 (FIG. 11).

Figure 12:
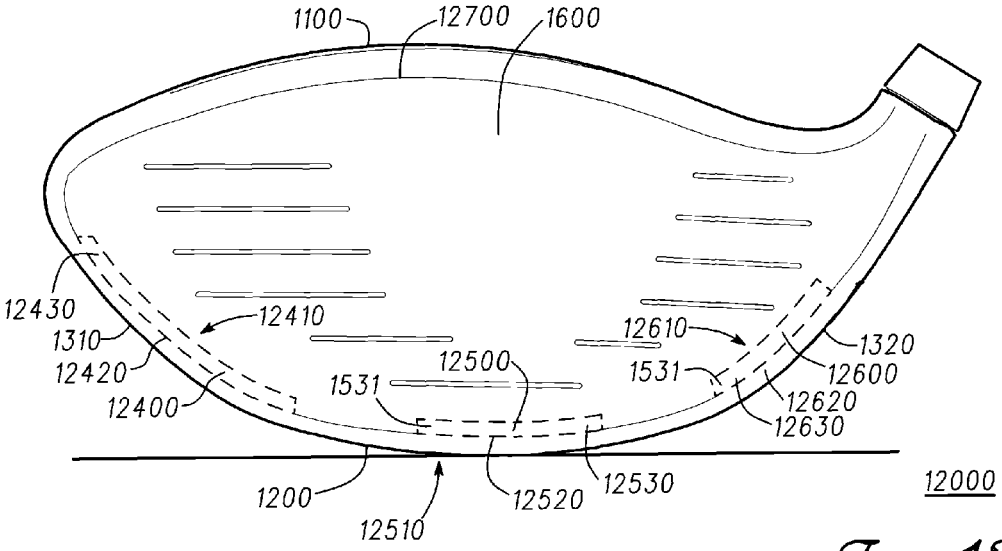
FIG. 12 illustrates a front view of another golf club head at address according to another embodiment.

FIG. 12 illustrates another example, presenting a front view of golf club head 12000 comprising multiple deflection junctions, such as deflection junction 12500 located along a front segment of sole 1200, deflection junction 12600 located along a front segment of heel skirt 1320, and deflection junction 12400 located along a front segment of toe skirt 1310. In such an example, FIG. 5 can correspond to a cross-sectional view of golf club head 12000 through one of deflection junctions 12500, 12600, or 12400, where deflection junction 5500 (FIG. 5) can correspond to deflection junction 12500, 12600, or 12400 (FIG. 12), where junction slot 5530 (FIG. 5) can correspond to junction slot 12530, 12630, or 12430 (FIG. 12), where junction segment 5510 (FIG. 5) corresponds to junction segment 12510, 12610, or 12410 (FIG. 12), and/or where junction structure 5520 (FIG. 5) can correspond to junction structure 12520, 12620, or 12420 of deflection junction 12500, 12600, or 12400 (FIG. 12).

Some embodiments can comprise deflection junctions and fixed joints located opposite each other. As an example, if the fixed joint extends adjacent to one of the crown or the sole of a golf club head, the deflection junction extends adjacent to a different one of the crown or the sole of the golf club head. For instance, FIG. 1 shows fixed joint 1700 extending adjacent to crown 1100, while deflection junction 1500 extends adjacent to sole 1200 opposite fixed joint 1700. FIG. 6 shows fixed joint 6700 extending adjacent to crown 1100, while deflection junction 6500 extends adjacent to sole 1200 opposite fixed joint 6700. FIG. 11 shows fixed joint 11700 extending adjacent to sole 1200, while deflection junction 11500 extends adjacent to crown 1100 opposite fixed joint 11700.

As another example, if the fixed joint extends adjacent to one of the heel skirt or the toe skirt of a golf club head, the deflection junction extends adjacent to a different one of the heel skirt or the toe skirt of the golf club head. For instance, FIG. 7 shows fixed joint 7700 extending adjacent to toe skirt 1310, while deflection junction 7500 extends adjacent to heel skirt 1320 opposite fixed joint 7700. FIG. 8 shows fixed joint 8700 extending adjacent to heel skirt 1320, while deflection junction 8500 extends adjacent to toe skirt 1310 opposite fixed joint 8700. FIG. 9 shows fixed joint 9700 extending adjacent to heel skirt 1320, while deflection junction 9500 extends adjacent to toe skirt 1310 opposite fixed joint 9700. FIG. 10 shows fixed joint 10700 extending adjacent to toe skirt 1310, while deflection junction 10500 extends adjacent to heel skirt 1320 opposite fixed joint 10700.

Focusing on the zoomed view of FIG. 5, deflection junction 5500 comprises pivot bend 5540 between junction segment 5510 and junction structure 5520, where pivot bend 5540 is configured to pivot junction structure 5520 towards an interior of the golf club head and relative to junction segment 5510 upon impact between strikeface 1610 and golf ball 2000 (FIG. 4). In some examples, pivot bend 5540 can comprise a thickness 5541 of approximately 0.75 mm to approximately 3.8 mm.

Junction structure 5520 is configured to overlap backface 4630 of strikeplate 1600 at backface overlap segment 5631 and along deflection junction 5500, thereby providing a backstop such that backface overlap segment 5631 of strikeplate 1600 won't displace unrestricted towards the interior of the golf club head upon impact with golf ball 2000, and providing structural support against which deflection junction 5500 can cause strikeplate 1600 to rebound for better characteristics such as increased launch angle and decreased ball spin.

Deflection junction 5500 comprises compressible material 1531 located at junction slot 5530 between junction structure 5520 and each of strikeplate perimeter 1620 and backface overlap segment 5631 of backface 4630. There can be other examples, however, where compressible material 1531 need not extend to strikeplate perimeter 1620 and/or would contact strikeplate 1600 only at backface 4630. In the present example, compressible material 1531 is configured to compress between backface overlap segment 5631 and junction structure 5520 upon impact with golf ball 2000 to permit deflection of strikeplate 1600 relative to junction structure 5520. In some examples, compressible material 1531 can comprise a Poisson ratio greater than approximately 0.4. In the same or other examples, compressible material 1531 can comprise a polyurethane material or a rubber material, amongst others. Compressible material 1531 is non-metallic, and thus junction slot 5530 comprises a non-metallic gap between strikeplate 1600 and junction segment 5510, and between strikeplate 1600 and junction structure 5520. Junction slot 5530 and compressible material 1531 comprise a bent such as to continuously extend from strikeplate perimeter 1620 to overlap backface 4630 within an interior of the golf club head.

As can be seen in FIG. 5, the forward end of junction slot 5530 is visible from forward of the front end of the golf club head. Correspondingly, junction slots 1530 (FIG. 1,4), 5530 (FIG. 5), 6530 (FIG. 6), 7530 (FIG. 7), 8530 (FIG. 8), 9530 (FIG. 9), 10530 (FIG. 10), 11530 (FIG. 11), 12530, 12630, and 12430 (FIG. 112) are visible from forward of their respective golf club heads, but none are visible at a bottom of sole 1200 and thus none are exposed contact with a ground playing surface during a golf swing.

FIG. 5 also highlights how junction structure 5520 can be subdivided into front wall portion 5521 and rear wall portion 5522. As can be seen in FIG. 4, loft plane 4615 extends through strikepoint 1611 of strikeface 1610, and backplane 4625 extends parallel to loft plane 4615 and through backpoint 4821, which is located opposite strikepoint 1611. In some examples, strikepoint 1611 can comprise a center and/or an engineered impact point of strikeface 1610. As seen in FIG. 5, front wall portion 5521 of junction structure 5520 is located between loft plane 4615 and backplane 4625, and rear wall portion 5522 of junction structure 5520 is located rearwards of backplane 4625.

In the present example, front wall portion 5521 of junction structure 5521 extends non-perpendicular with to loft plane 4615 and non-parallel to ground plane 1910 when the golf club head is at address. Furthermore, rear wall portion 5522 overlaps backface overlap segment 5631 of backface 4630 and, in the present embodiment, rear wall portion 5522 of junction structure 5520 extends substantially parallel to loft plane 4615 and to backface overlap segment 5631.

Strikeplate 1600 is non-welded to junction structure 5520 to permit deflection of strikeplate perimeter 1620 and backface overlap segment 5631 relative to junction structure 5520 and/or junction segment 5510. Compressible material 1531 within junction slot 5530 maintains strikeplate 1600 and junction structure 5520 separated from each other throughout ball impact of strikeface 1610 with a golf ball. In some examples, minimum thickness 5535 of junction slot 5530, from backface 4630 to junction structure 5520, can be at least approximately 0.5 mm.

Compressible material 1531 is configured to absorb impact stresses associated with such ball impact, compressing to permit deflection of strikeplate 1600 towards the interior of the golf club head, and then decompressing to deflect strikeplate 1600 towards the exterior of the golf club head. In the same or other examples, during ball impact, junction structure 5520 can be configured to pivot inwards towards the interior of the golf club head, and to then pivot outwards towards the exterior of the golf club head. For example, in some embodiments, upon impact between strikeface 1610 and golf ball 2000 at approximately 50 mph to approximately 150 mph, deflection junction 5500 can permit strikeplate perimeter 1620 to deflect, relative to junction structure 5520, between approximately 0.5 mm to approximately 1.5 mm towards the interior of the golf club head. Such deflection of strikeplate 1600 afforded by junction structure 5520 and/or by the compression and decompression of compressible material 1531 can impart better flight characteristics to golf ball 2000, such as increased launch angle, increased launch speed, and/or decreased ball spin.

Figure 13:
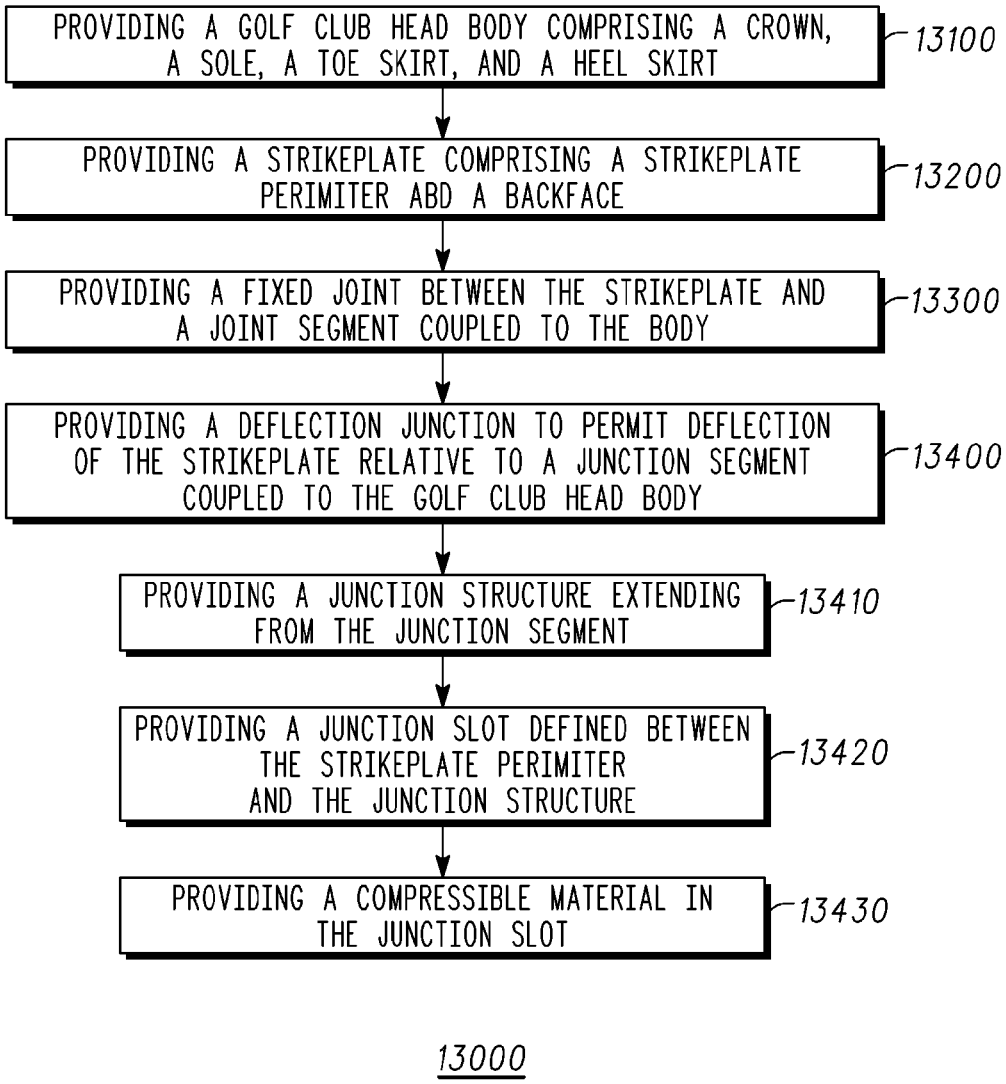
FIG. 13 illustrates a flowchart for a method of providing a golf club head in accordance with the present disclosure and the different embodiments described herein.

Continuing to FIG. 13, a flowchart is presented therein for a method of providing a golf club head in accordance with the present disclosure. In some examples, the golf club head can be similar to one or more of the golf club heads discussed above with respect to FIGS. 1-12.

Block 13100 of method 13000 involves providing a golf club head body comprising a crown, a sole, a toe skirt, and a heel skirt. In some examples, the body of the golf club head can be similar to the body of one or more of the golf club heads described above. For instance, the crown can be similar to crown 1100 (FIGS. 1, 2, 4, and 6-12), the sole can be similar to sole 1200 (FIGS. 1 and 3-12), the toe skirt can be similar to toe skirt 1310 (FIGS. 1, 3, and 6-12), and the heel skirt can be similar to heel skirt 1320 (FIGS. 1, 3, and 6-12).

Block 13200 of method 13000 involves providing a strikeplate comprising a strikeplate perimeter and a backface. In some examples, the strikeplate can be similar to strikeplate 1600 (FIGS. 1-12) having strikeface 1610 (FIGS. 1, 2, and 4-12), backface 4630 (FIGS. 4-5), and strikeplate perimeter 1620 (FIGS. 1, 2, 4, 5).

Method 13000 also comprises block 13300 for providing a fixed joint between the strikeplate and a joint segment coupled to the body. In some examples, the fixed joint can be similar to fixed joint 1700 between strikeplate 1600 and to joint segment 1710 (FIGS. 1, 2, 4). As other examples, the fixed joint can be similar to fixed joint 6700 (FIG. 6), fixed joint 7700 (FIG. 7), fixed joint 8700 (FIG. 8), fixed joint 9700 (FIG. 9), fixed joint 10700 (FIG. 10), fixed joint 11700 (FIG. 11), or fixed joint 12700 (FIG. 12).

Method 13000 further comprises block 13400 for providing a deflection junction to permit deflection of the strikeplate relative to a junction segment coupled to the body. In some examples, the deflection junction can be similar to deflection junction 1500 permitting deflection of strikeplate 1600 relative to junction segment 1510 (FIG. 1, 2, 4). The deflection junction can also be similar to deflection junction 6500 (FIG. 6), deflection junction 7500 (FIG. 7), deflection junction 8500 (FIG. 8), deflection junction 9500 (FIG. 9), deflection junction 10500 (FIG. 10), deflection junction 11500 (FIG. 11), or one or more of deflection junctions 12400, 12500, or 12600 (FIG. 12). The deflection junction can also be similar to deflection junction 5500 as detailed in FIG. 5, which can represent any of the other deflection junctions described herein with respect to the embodiments of FIGS. 1-4 and 6-12.

Block 13400 can comprise sub-block 13410 for providing a junction structure extending from the junction segment. For instance, the junction structure can be similar to junction structure 1520 (FIGS. 1,4), and/or to junction structure 5520 (FIG. 5).

Block 13400 can also comprise sub-block 13420 for providing a junction slot defined between the strikeplate perimeter and the junction structure. As an example, the junction slot can be similar to junction slot 1530 (FIGS. 1, 2, 4), junction slot 5530 (FIG. 5), junction slot 6530 (FIG. 6), junction slot 7530 (FIG. 7), junction slot 8530 (FIG. 8), junction slot 9530 (FIG. 9), junction slot 10530 (FIG. 10), junction slot 11530 (FIG. 11), and/or one or more of junction slots 12430, 12530, or 12630 (FIG. 12).

Block 13400 can further comprise sub-block 13430 for providing a compressible material in junction slot 13420. In some examples, the compressible material can be similar to compressible material 1531 (FIGS. 1, 2, 4-12).

There can be examples where different blocks of method 13000 can be combined into a single block or performed simultaneously, and/or where the sequence of such blocks can be changed. For example, the sequence of blocks 13100 and 13200 can be inverted in some implementations. As another example, blocks 13100 and 13200 can be combined into a single block, such as where the strikeplate is integral or made out of a single piece with one or more of the crown, the sole, the toe skirt, or the heel skirt of the golf club head body. In some examples, some of the blocks of method 13000 can be optional. For instance, block 13300 can be optional in cases where the strikeplate is integral with another part of the golf club head body as described above. As another example, block 13430 can be optional in the same or other implementations. There can also be examples where method 13000 can comprise further or different blocks. As an example, method 13000 can comprise another block for coupling a golf club shaft to the golf club head. Other variations can be implemented for method 13000 without departing from the scope of the present disclosure.

Although the golf club heads with deflection junctions and related methods herein have been described with reference to specific embodiments, various changes may be made without departing from the spirit or scope of the present disclosure. As an example, compressible material 1531 can comprise a variable density material in some implementations having variable density or flexibility along the deflection junction where it is located. In the same or other examples, the flexibility or density of compressible material 1531 can be varied from club head to club head of a golf club head set. Additional examples have been given in the foregoing description. Other permutations of the different embodiments having one or more of the features of the various figures are likewise contemplated. Accordingly, the disclosure herein is intended to be illustrative and is not intended to be limiting. It is intended that the scope of this application shall be limited only to the extent required by the appended claims.

The golf club heads with deflection junctions and related methods discussed herein may be implemented in a variety of embodiments, and the foregoing discussion of certain of these embodiments does not necessarily represent a complete description of all possible embodiments. Rather, the detailed description of the drawings, and the drawings themselves, disclose at least one preferred embodiment, and may disclose alternative embodiments.

As the rules to golf may change from time to time (e.g., new regulations may be adopted or old rules may be eliminated or modified by golf standard organizations and/or governing bodies such as the United States Golf Association (USGA), the Royal and Ancient Golf Club of St. Andrews (R&A), etc.), golf equipment related to the apparatus, methods, and articles of manufacture described herein may be conforming or non-conforming to the rules of golf at any particular time. Accordingly, golf equipment related to the apparatus, methods, and articles of manufacture described herein may be advertised, offered for sale, and/or sold as conforming or non-conforming golf equipment. The apparatus, methods, and articles of manufacture described herein are not limited in this regard.

While the above examples may be described in connection with a driver-type golf clubs, the apparatus, systems, methods, and articles of manufacture described herein may be applicable to other types of golf club such as a fairway wood-type golf club, a hybrid-type golf club, an iron-type golf club, a wedge-type golf club, or a putter-type golf club. Alternatively, the apparatus, methods, and articles of manufacture described herein may be applicable to other type of sports equipment such as a hockey stick, a tennis racket, a fishing pole, a ski pole, etc.

All elements claimed in any particular claim are essential to the embodiment claimed in that particular claim. Consequently, replacement of one or more claimed elements constitutes reconstruction and not repair. Additionally, benefits, other advantages, and solutions to problems have been described with regard to specific embodiments. The benefits, advantages, solutions to problems, and any element or elements that may cause any benefit, advantage, or solution to occur or become more pronounced, however, are not to be construed as critical, required, or essential features or elements of any or all of the claims, unless such benefits, advantages, solutions, or elements are expressly stated in such claims.

Moreover, embodiments and limitations disclosed herein are not dedicated to the public under the doctrine of dedication if the embodiments and/or limitations: (1) are not expressly claimed in the claims; and (2) are or are potentially equivalents of express elements and/or limitations in the claims under the doctrine of equivalents.

The invention claimed is:

1. A golf club head comprising:
a crown, a sole, a toe skirt, a heel skirt; and
a front end comprising:
a strikeplate comprising:
a strikeface;
a backface; and
a strikeplate perimeter;
a fixed joint between the strikeplate and a joint segment comprising at least one of a front of one of:
the crown, the sole, the toe skirt, or the heel skirt;
and
a deflection junction configured to permit deflection between the strikeplate and a junction segment comprising at least one of the front of a different one of:
the crown, the sole, the toe skirt, or the heel skirt;
wherein:
the deflection junction comprises:
a junction structure extending from the junction segment;
a junction slot defined between the strikeplate perimeter and the junction structure; and
a compressible material located at the junction slot between the junction structure and at least one of:
the strikeplate perimeter; and
the backface of the strikeplate;
the strikeplate perimeter is disconnected from the junction segment;
the strikeface comprises a strikepoint through which a loft plane extends;
the backface comprises a backpoint located opposite the strikepoint and through which a backplane extends;
the backplane is parallel to the loft plane; and
the junction structure comprises:
a front wall portion located between the loft plane and the backplane; and
a rear wall portion located rearwards of the backplane.

2. The golf club head of claim 1, wherein:
if the fixed joint extends adjacent to one of the crown or the sole:
the deflection junction extends adjacent to a different one of the crown or the sole; and
if the fixed joint extends adjacent to one of the toe skirt or the heel skirt:
the deflection junction extends adjacent to a different one of the toe skirt or the heel skirt.

3. The golf club head of claim 1, wherein:
the junction segment comprises the front of the sole and at least one of:
the front of the toe skirt and the front of the heel skirt.

4. The golf club head of claim 1, wherein:
the deflection junction comprises:
a pivot bend between the junction segment and the junction structure and configured to pivot the junction structure relative to the junction segment upon impact between the strikeface and a golf ball.

5. The golf club head of claim 1, wherein:
the compressible material comprises at least one of:
a polyurethane material;
a rubber material; or
a Poisson ratio greater than approximately 0.4.

6. The golf club head of claim 1, wherein:
a forward end of the junction slot is visible from forward of the front end of the golf club head and from a top address point of view of the golf club head.

7. The golf club head of claim 1, wherein:
the junction slot is not exposed to an underside of the golf club head.

8. A golf club head comprising:
a crown, a sole, a toe skirt, a heel skirt; and
a front end comprising:
a strikeplate comprising:
a strikeface;
a backface; and
a strikeplate perimeter;
a fixed joint between the strikeplate and a joint segment comprising a crown front portion, a toe skirt front portion, and a heel skirt front portion;
and
a deflection junction configured to permit deflection between the strikeplate and a junction segment comprising a sole front portion;
wherein:
the deflection junction comprises a junction slot defined between the strikeplate perimeter and the junction segment; and
the strikeplate perimeter is disconnected from the junction segment.

9. The golf club head of claim 8, wherein:
the deflection junction comprises:
a compressible material located at the junction slot between the junction segment and at least one of:
the strikeplate perimeter; and
the backface of the strikeplate.

10. The golf club head of claim 9, wherein:
the compressible material comprises at least one of:
a polyurethane material;
a rubber material; and
a Poisson ratio greater than approximately 0.4.

11. The golf club head of claim 8, wherein:
a minimum thickness of the junction slot, from the backface to the junction segment, is at least approximately 0.5 mm.

12. The golf club head of claim 8, wherein:
upon impact between the strikeface and a golf ball at approximately 50 miles per hour to approximately 150 miles per hour:
the deflection junction is configured to permit the strikeplate perimeter to deflect, relative to the junction segment, between approximately 0.5 mm to approximately 1.5 mm.

13. The golf club head of claim 8, wherein:
the deflection junction further comprises:
a junction structure extending from the junction segment; and
a pivot bend between the junction segment and the junction structure and configured to permit pivoting of the junction structure relative to the junction segment upon impact between the strikeface and a golf ball.

14. The golf club head of claim 8, wherein:
a forward end of the junction slot is visible from forward of the front end of the golf club head and from a top address point of view of the golf club head.

15. The golf club head of claim 8, wherein:
the junction slot is not exposed to an underside of the golf club head.

16. A method for providing a golf club head, the method comprising:
providing a crown, a sole, a toe skirt, a heel skirt; and
providing a front end of the golf club head;
wherein:
providing the front end comprises:
providing a strikeplate comprising:
a strikeface;
a backface; and
a strikeplate perimeter;
providing a fixed joint between the strikeplate and a joint segment comprising at least one of a front of one of:
the crown, the sole, the toe skirt, or the heel skirt;
and
providing a deflection junction configured to permit deflection between the strikeplate and a junction segment comprising at least one of the front of a different one of:
the crown, the sole, the toe skirt, or the heel skirt;
the deflection junction comprises:
a junction structure extending from the junction segment;
a junction slot defined between the strikeplate perimeter and the junction structure;
and
a compressible material located at the junction slot between the junction structure and at least one of:
the strikeplate perimeter; and
the backface of the strikeplate;
the strikeplate perimeter is disconnected from the junction segment;
the strikeface comprises a strikepoint through which a loft plane extends;
the backface comprises a backpoint located opposite the strikepoint and through which a backplane extends;
the backplane is parallel to the loft plane; and
the junction structure comprises:
a front wall portion located between the loft plane and the backplane; and
a rear wall portion located rearwards of the backplane.

17. The method of claim 16, wherein:
the junction segment comprises the front of the sole and at least one of the front of the toe skirt or the front of the heel skirt; and
the junction structure overlaps a segment of the backface, proximate to the strikeplate perimeter, and along the deflection junction.

18. The method of claim 16, wherein:
the junction slot is visible from forward of the front end of the golf club head; and
the junction slot is not exposed to an underside of the golf club head.

19. The method of claim 16, wherein:
the compressible material comprises at least one of:
a polyurethane material;
a rubber material; or
a Poisson ratio greater than approximately 0.4.

20. The method of claim 16, further comprising:
the front wall portion of the junction structure is non-perpendicular to the loft plane; and
the rear wall portion overlaps a segment of the backface.

* * * * *